United States Patent [19]

Svoboda

[11] Patent Number: 4,552,378

[45] Date of Patent: Nov. 12, 1985

[54] SAFETY SKI BINDING

[75] Inventor: Josef Svoboda, Schwechat, Austria

[73] Assignee: TMC Corporation, Baar, Switzerland

[21] Appl. No.: 585,723

[22] Filed: Mar. 2, 1984

[30] Foreign Application Priority Data

Mar. 11, 1983 [AT] Austria ..... 878/83

[51] Int. Cl.[4] ..... A63C 9/08

[52] U.S. Cl. ..... 280/632

[58] Field of Search ..... 280/626, 631, 632, 634

[56] References Cited

U.S. PATENT DOCUMENTS

| | | | |
|---|---|---|---|
| 3,734,520 | 5/1973 | Hashioka | 280/632 |
| 3,778,073 | 12/1973 | Salomon | 280/632 |
| 3,933,363 | 1/1976 | Schweizer et al. | 280/632 |
| 3,990,724 | 11/1976 | Schweizer et al. | 280/632 |
| 4,307,895 | 12/1981 | Storandt et al. | 280/632 |

FOREIGN PATENT DOCUMENTS

| | | | |
|---|---|---|---|
| 327759 | 2/1976 | Austria . | |
| 2200768 | 7/1972 | Fed. Rep. of Germany . | |
| 2700834 | 7/1977 | Fed. Rep. of Germany . | |
| 2707780 | 8/1977 | Fed. Rep. of Germany | 280/632 |
| 3122259 | 5/1982 | Fed. Rep. of Germany . | |
| 3122653 | 12/1982 | Fed. Rep. of Germany . | |

*Primary Examiner*—Joseph F. Peters, Jr.
*Assistant Examiner*—Michael Mar
*Attorney, Agent, or Firm*—Flynn, Thiel, Boutell & Tanis

[57] ABSTRACT

A safety ski binding includes a bearing block having an axle thereon, a sole holder pivotally supported on the axle, and a spring housing supported on the bearing block for pivotal movement about an axis which is generally parallel to the axle. A slide member is movably supported in the spring housing and is biased by a release spring into engagement with a control surface on the sole holder in the downhill skiing position of the binding. The axle is closer to the tail of the ski than the axis, and the control surface on the sole holder includes a cam which engages the slide member in the region between the axle and axis. The slide member has a control recess therein and the axle extends through the control recess, pivotal movement of the spring housing causing the axle to engage an inclined surface of the slide member and move the slide member away from the sole holder against the urging of the release spring.

7 Claims, 3 Drawing Figures

SAFETY SKI BINDING

FIELD OF THE INVENTION

This invention relates to a safety ski binding and, in particular, to a heel holder having a sole holder pivotally supported on a bearing block by a swivel axle which extends transversely to the longitudinal direction of the ski and parallel to the upper side of the ski, which sole holder is held in downhill skiing position by a locking member which cooperates with a control surface, the sole holder being biased by a slide member which is guided movably against the force of the release spring in a spring housing, the spring housing being supported on the bearing block for pivotal movement about an axis which extends parallel to the axle, and the spring housing simultaneously serving as the operating lever for effecting a voluntary opening of the sole holder.

BACKGROUND OF THE INVENTION

A typical safety ski binding of the above-mentioned type is illustrated in FIGS. 1 to 3 of Austrian Pat. No. 327 759. In this conventional design, the control surface is constructed on the sole holder, the locking member is a rounded portion of the slide member, and the slide member is constructed approximately wedge-shaped as viewed in a side view. The sole holder is supported swingably at the front end region of the bearing block, and the swivel axis of the spring housing is offset rearwardly with respect to the swivel axis of the sole holder. The control surface of the sole holder is designed as a flat surface, and in the downhill skiing position of the heel holder the slide member is supported on the upper end region of the control surface. Through the flat design of the control surface on the sole holder, there results during a release of the heel holder by swinging of the sole holder a dead-center position of the slide member on the control surface, which dead-center position limits the elasticity range. Through this, the tension of the spring in the downhill skiing position and in the open position of the sole holder is approximately the same. By providing the swivel axis of the sole holder at the front end of the bearing block, it is not possible to open the sole holder sufficiently wide for a reasonable height of the binding, so that stepping into the sole holder is difficult. Furthermore, this binding has, due to its construction, only a small elasticity, and there exists due to the whiplike support of the spring housing which receives the slide member a certain danger with respect to injuries during the voluntary opening of the binding, since the spring housing which simultaneously serves as the operating member, after exceeding its dead-center position, tilts under the action of the release spring.

German Offenlegungsschrift No. 31 22 653 illustrates a safety ski binding in which a holding part which carries the sole holder is supported for pivotal movement about an axis which extends transversely to the longitudinal axis of the ski and is arranged on the bearing block. The region of the holding part which lies opposite the sole holder with respect to the swivel axis is designed as a spring housing which receives the release spring which biases a slide member, the slide member being guided movably in the spring housing and cooperating with a camlike elevation which is arranged on the bearing block by means of a control surface which is arranged on its front side. The region of the holding part which receives the release spring serves simultaneously as an operating member for the voluntary opening of the binding. It is disadvantageous in this design that, due to the one-piece design of sole holder and operating member, during a pressing down of the operating plate the sole holder must automatically swing upwardly. Thus, stepping out of the binding, for example by pressing down the holding part with a ski or the ski shoe, is difficult, particularly for a less experienced skier, since there is the danger of losing his or her balance.

In the safety ski binding which is illustrated in FIGS. 1 to 4 of German Offenlegungsschrift No. 27 00 834, a piston which is biased by a release spring is guided movably inside of a bearing block which is arranged on the ski and the piston cooperates by means of a nose with a control surface which is provided on the sole holder. The sole holder is supported pivotally on an axle which is provided on the bearing block, and extends through a free positioning recess in the piston so that movement of the piston is not influenced by the axle. Parallel to the swivel axle of the sole holder there is provided a further axle which is connected fixedly to the piston, on which further axle is supported pivotally a release lever. The swivel axle of the sole holder engages furthermore control recesses which are provided on the sidewalls of the release lever. During an automatic release, for example due to a fall of the skier, the control surface which is on the sole holder moves the piston against the force of the release spring until finally the open position of the sole holder is reached, in which position the release spring can slightly relax. For a voluntary opening of the sole holder, the release lever is pressed down, whereby edges of the control recesses slide on the swivel axle of the sole holder, which causes the piston to be moved back against the force of the release spring. This permits the sole holder, assisted by a spring which urges it in the opening direction, to swing into its open position. Disadvantageous in this design is that, by arranging the release spring and the slide member in the bearing block, which is arranged on the ski, for a voluntary opening of the binding a separate structural part such as the release lever, is needed.

Therefore, a purpose of the invention is to provide a safety ski binding of the above-mentioned type which does not have the disadvantages of conventional designs, which has few structural parts and thus is built compactly and simply, which can be manufactured easily, and which is comfortable for inexperienced skiers to operate.

SUMMARY OF THE INVENTION

The set purpose is attained inventively by providing a control surface on the slide member, by the control surface on the sole holder being a control cam, by the swivel axle of the sole holder being offset toward the end of the ski relative to the axis of the spring housing so that in the downhill skiing position the slide member biases the control cam of the sole holder in the region between the axle and axis and by providing a control recess in the slide member through which the swivel axle of the sole holder extends.

A very simple, easily manufacturable safety ski binding is created through these inventive measures. Through the inventive arrangement for biasing the control cam of the sole holder with the slide member, a moment is applied by the control cam onto the spring housing which maintains the spring housing in a position of equilibrium in the downhill skiing position, without which additional structure to hold the spring housing would be necessary. The binding therefore has the advantages of the binding which is disclosed in German Offenlegungsschrift No. 31 22 653, but without the above-mentioned disadvantage which results from the integral design of the sole holder and spring housing. The control recess in the slide member which receives the swivel axle of the sole holder permits a satisfactory safety release and a troublefree voluntary opening of the binding simply by applying pressure onto the spring housing, which also serves as the release lever.

It is known already from German Offenlegungsschrift No. 27 07 780 to bias a roller provided in the rear region of a sole holder by means of an inclined surface on the spring-biased slide member. However, the surfaces which thereby engage one another are not control cams in the sense of the invention. Furthermore, the spring-biased slide member is not simultaneously used as a release lever for the voluntary opening of the sole holder which, as discussed in the introduction, is a feature of the state of the art to which the invention relates. Thus, there exists a difference in classification. The slide member itself is disposed in a part which is movable longitudinally of the ski against the force of a further spring and which carries the sole holder or the release lever on respective axes which extend transversely to the longitudinal direction of the ski and parallel to the upper side of the ski. The release lever can, for opening the binding, engage a counterstop on the slide member, but during a voluntary opening and also during an automatic release the entire force of the release spring must be overcome.

A further characteristic of the invention involves the control surface on the slide member having two surface sections, of which the lower one, in the downhill skiing position of the binding, engages the control cam of the sole holder and lies completely below a plane which contains the axis of the spring housing and which extends parallel to the central longitudinal axis of the spring housing. The spring housing is held by this measure throughout the entire elasticity range of the heel holder in a position of equilibrium in the downhill skiing position, so that proper release forces exist.

A further inventive development of the control surface on the slide member involves the second surface section of the control surface on the slide member being arcuate, the centerpoint of its curvature, with reference to the central longitudinal axis of the spring housing, being offset with respect to the swivel axle of the sole holder both toward the upper side of the ski and also toward the rear end of the ski. Through this, a perfect opening of the sole holder after exceeding the elasticity range of the heel holder is assured and, in addition, a slightly increasing stepping-in force is produced in a desired manner during re-inserting of a ski shoe.

A further inventive development involves the surface section of the cam on the slide member which engages the control cam of the sole holder in the downhill skiing position being designed as a flat surface which extends at an acute angle of roughly 30° with respect to the central longitudinal axis of the spring housing. In this manner, a particularly advantageous relationship is produced between the force which holds the sole holder in the downhill skiing position and the force component which, during a release, is transmitted from the sole holder through the slide member to the release spring.

A further advantage of the invention involves the control recess of the slide member which receives the swivel axle of the sole holder being approximately triangular when viewed in a side view and defining two control paths for the swivel axle of the sole holder. One control path extends parallel to the central longitudinal axis of the spring housing, and the other control path limits the recess at its end remote from the sole holder and is inclined in a direction toward the sole holder. Thus, the control recess provides the necessary free positioning for the swivel axle of the sole holder during a release, and the second control path, during a voluntary opening of the heel holder, causes the slide member to be moved back sufficiently far so that the sole holder can swing unhindered into its open position.

A further characteristic of the invention involves the swivel axis of the sole holder extending through two arcuate slots in the sidewalls of the spring housing which are concentric with respect to the swivel axis of the spring housing. The slots permit the swinging movement of the spring housing relative to the bearing-block-supported swivel axle of the sole holder.

Furthermore, according to the invention, the axis of the spring housing is formed by two half bolts which each are provided on a respective sidewall of the bearing wall and support a respective sidewall of the spring housing. With this, a particularly simple construction of the axis of the spring housing, which construction does not influence the slide member movement, is achieved.

BRIEF DESCRIPTION OF THE DRAWINGS

Further characteristics, advantages and details of the invention will now be described in connection with the drawings, which illustrate one exemplary embodiment of a safety ski binding embodying the invention.

In the drawings.

DETAILED DESCRIPTION

Figure 1:
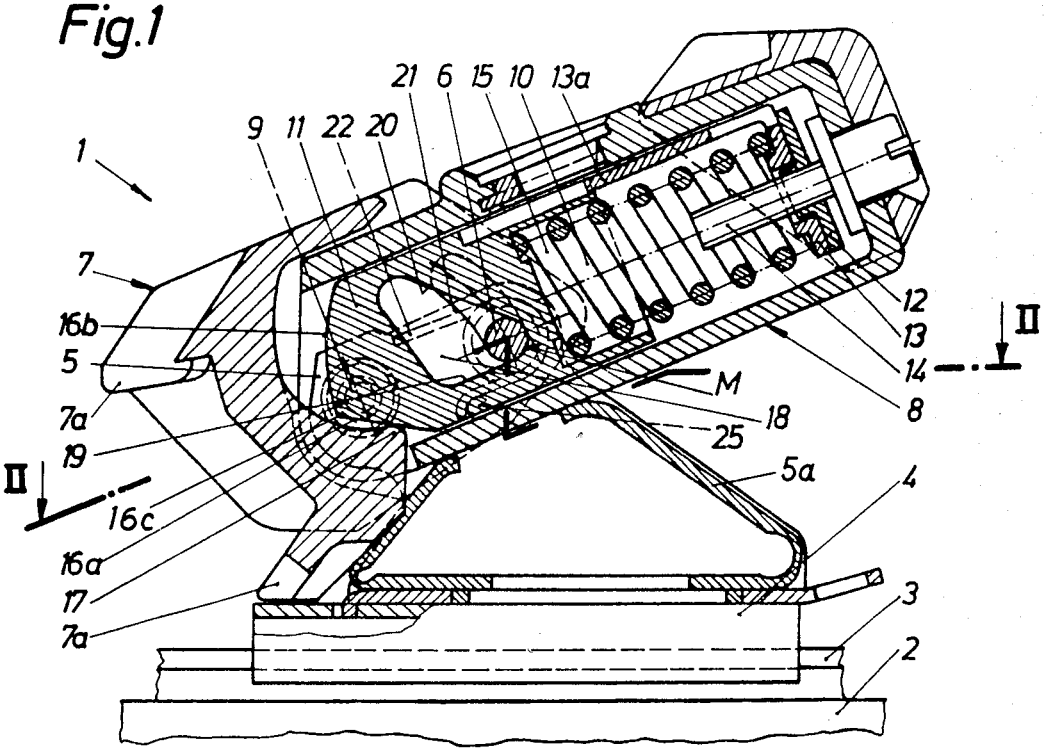
FIG. 1 is a sectional side view of a safety ski binding which embodies the invention and which is shown in its downhill skiing position.

The safety ski binding which is illustrated in the drawings is a heel holder which is identified as a whole with reference numeral 1. A guide rail 3 is secured by means of not illustrated screws to the upper side of a ski 2, on which guide rail a guide plate 4 of the heel holder 1 is supported for movement longitudinally of the ski 2 and can be releasably locked in various locations in a conventional manner by a conventional and not illustrated mechanism to facilitate adjustment of the binding to different length ski shoes. The guide plate 4 is movable on the guide rail 3 against the force of at least one conventional and not illustrated thrust spring, the thrust spring, in a conventional manner, having one end fixed against movement relative to the ski and its other end supported on the guide plate 4 of the heel holder 1.

A bearing block 5 is secured on the guide plate 4 and includes a base plate and two laterally spaced sidewalls which are upright and extend parallel to the longitudinal axis of the ski. The bearing block 5 carries a horizontal swivel axle 6 which extends transversely of the ski and is a bolt, and on which swivel axle 6 is pivotally supported a sole holder 7 which has laterally spaced arms disposed on opposite sides of the bearing block 5. The sole holder 7 is provided in a conventional manner with a down-holding portion 7*a* which grips from above over a sole of the ski shoe and a stepping spur 7*b* which cooperates with the underside of the shoe sole.

Furthermore, an axle which is formed by two pins or half bolts 9 is provided on the bearing block 5 in a region near the sole holder 7, on which axle is supported pivotally a spring housing 8. As can particularly be seen from FIG. 2, the spring housing 8 is supported through its two sidewalls on the bearing block 5 by means of the half bolts 9. The spring housing 8 is approximately rectangular and is closed except for its end which faces the sole holder 7. The spring housing 8 has therein at least one release spring 10 which has one end supported on an indicating part 13 provided on a spring abutment 12, and at its other end biases a slide member 11. The spring abutment 12 is provided on and threadedly engages a screw 14 which is supported rotatably in the spring housing 8, and the abutment 12 can thus be adjusted in the axial direction of the spring housing 8 in a conventional manner by rotating the screw 14 in order to adjust the initial tension of the release spring 10. The indicating part 13 which is provided on the spring abutment 12 is provided with an indicating arm 13*a*, which in a conventional manner is visible through a window which is provided in the spring housing 8 and which has a scale next to it for indicating the adjusted initial tension of the spring 10.

The slide member 11 is provided with a blind hole 15 which receives the left end of the release spring 10. The slide member 11 is slidably supported in the spring housing 8 for movement in the longitudinal direction of the housing and, in the downhill skiing position of the heel holder 1 shown in FIG. 1, slidably engages a control cam 17 provided on the sole holder 7. The surface of the slide member 11 which faces the sole holder 7 is a control surface 16 which has two surface sections 16*a*, 16*b*. The surface section 16*a* of the control surface 16 is designed in the present exemplary embodiment as a flat surface which extends at an angle of approximately 23° to 32° with respect to the central longitudinal axis of the spring housing 8. In the downhill skiing position of the heel holder 1, the slide member 11 has its surface section 16*a* engaging the control cam 17 provided on the sole holder 7, and since the support of the control cam 17 on the surface section 16*a* occurs at a location slightly rightwardly of the axle 6 and just below a straight line which connects the swivel axle 6 and the axis which is defined by the two half bolts 9, a moment is applied onto the spring housing 8 which, in FIG. 1, urges the housing 8 in a counterclockwise direction and holds it in the position shown in FIG. 1. Consequently, the provision of a separate centering device for the spring housing 8 is not needed. The edge 16*c* between the two surface sections 16*a* and 16*b* determines the release point of the heel holder 1 and, in the downhill skiing position of the heel holder 1, is located a small distance below a straight line which intersects the axis of the two half bolts 9 and which extends parallel to the central longitudinal axis of the spring housing 8. The surface section 16*b* of the surface 16 is curved circularly, and the centerpoint M of such curvature, with reference to the central longitudinal axis of the spring housing 8, is slightly offset from the swivel axle 6 in a direction toward the upper side of the ski and in a rearward direction toward the spring abutment 12. The purpose of this curvature of the surface section 16*b* of the control surface 16 will be discussed later on. The elasticity range of the heel holder 1 is determined by the distance from the point of engagement of the control cam 17 and the surface section 16*a* to the edge 16*c* between the two surface sections 16*a* and 16*b*.

A control recess 18 is provided in the slide member 11 for the swivel axle 6, the axle 6 extending through this recess in the slide member 11, and the recess 18 extending transversely with respect to the longitudinal axis of the ski. The recess 18 is, viewed in a side view, approximately triangular, two of its walls defining respective control paths or surfaces 19 and 20 for the swivel axle 6. The control path 19 extends parallel to the central longitudinal axis of the spring housing 8 and release spring 10, and permits the slide member 11 to move rightwardly in the spring housing 8 against the force of the release spring 10 relative to the swivel axle 6 through a distance which is at least as long as the elasticity range of the heel holder 1. The second control path 20 defines the side of the recess 18 remote from the sole holder 7, is inclined in an upward direction toward the sole holder 7, and in the present exemplary embodiment is a flat surface. The longitudinal length of the path 20 is adjusted to the length in the longitudinal direction of two slots 21 which are provided in the sidewalls of the spring housing 8, which extend concentrically with respect to the half bolts 9, and through which extends the swivel axle 6. The control path 20 and the slots 21 permit a voluntary opening of the sole holder 7 by pressing onto the spring housing 8, which thus simultaneously serves as a spring housing and as the operating or release lever for opening the binding. The voluntary release will be described in detail later.

Figure 2:
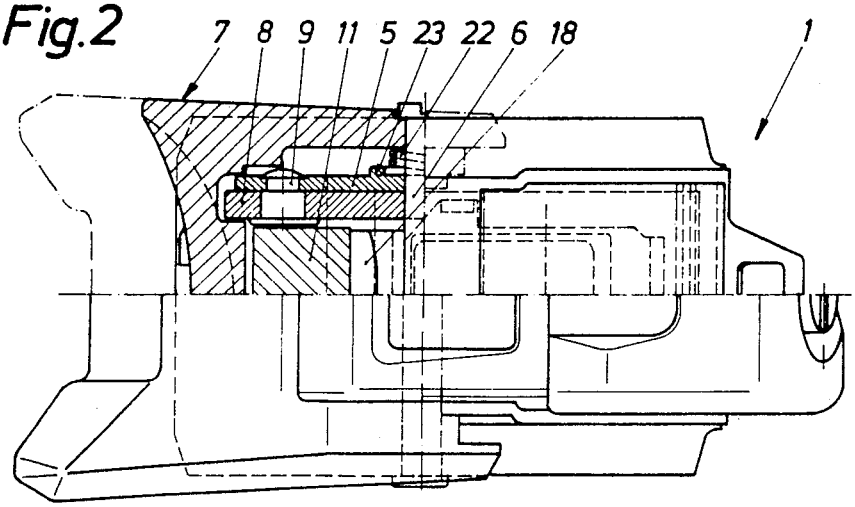
FIG. 2 is a top view of the binding of FIG. 1, the lower half being a top plan view and the upper half being a sectional top view taken along the line II—II in FIG. 1.

The sole holder 7 is biased by at least one opening spring 22 which urges it toward its open position. This spring is a torsion spring in the present exemplary embodiment which, as can be seen from FIG. 2, is supported on the axle 6 in the region between a sidewall or arm of the sole holder 7 and a sidewall of the bearing block 5, has one leg supported on the sole holder 7, and has its other leg supported on a stop pin 23 on the bearing block.

Figure 3:
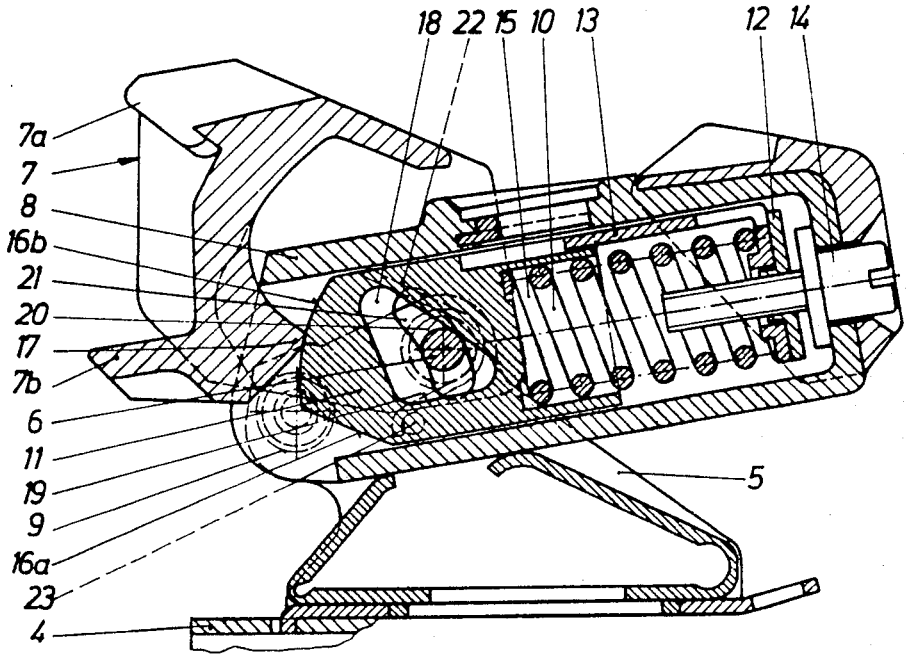
FIG. 3 is a sectional side view similar to FIG. 1 showing the safety ski binding of FIG. 1 in its open position.

The heel holder 1 operates as follows. If a force acts vertically onto the sole holder 7 from a ski shoe which is held in the sole holder 7, the sole holder 7 pivots upwardly about the swivel axle 6. During this pivoting movement, its control cam 17 slides on the surface 16*a* of the slide member 11 and moves the slide member 11 rearwardly against the force of the release spring 10 and into the spring housing 8. The control recess 18 in the slide member 11 permits this relative movement between the bearing-block-supported swivel axle 6 and the slide member 11. As soon as the control cam 17 on the sole holder 7 has pressed the slide member 11 back sufficiently far so that the edge 16*c* which separates the two surface sections 16*a* and 16*b* is exceeded, the force or moment which is applied by the control cam 17 onto the slide member 11 effects a swinging of the spring housing 8 downwardly. A force which urges the sole holder 7 upwardly toward its open position is now applied by the slide member 11 and the slightly relaxing release spring 10 as the control cam 17 slides upwardly along the surface section 16*b* until finally the open position according to FIG. 3 is reached. The pivoting of the spring housing 8 relative to the swivel axle 6 of the sole holder 7 is made possible by the two slots 21 provided in the spring housing 8. The heel holder 1 is thus in its open position in which it is ready for a ski shoe to step in, as illustrated in FIG. 3.

During a closing of the heel holder 1 by inserting of a ski shoe into the sole holder 7, the control cam 17 of the sole holder 7 initially acts onto the surface section **16*b* of the control surface 16 of the slide member 11. Through the above-described circular curvature of the surface section 16*b*, the slide member 11 is moved slightly backwards against the force of the release spring 10, through which a slight increase in the stepping-in force is achieved. As soon as the control cam 17 has passed the edge 16*c* which separates the two surface sections 16*a* and 16*b*, the spring housing 8 pivots about the half bolts 9 to its initial position, and the slide member 11 also moves under the urging of the release spring 10 to its initial position, so that the heel holder 1 is again in the downhill skiing position which is illustrated in FIG. 1**.

For a voluntary opening of the heel holder 1, the spring housing 8, which is also the operating or release lever, is pivoted manually in the direction of the upper side of the ski about the half bolts 9. The bearing-block-supported swivel axle 6, which extends through the control recess 18 in the slide member 11, slides along the path 20 of the slide member 11 and moves it backward against the force of the release spring 10. The relative movement between the axle 6 and the spring housing 8 is again assured by the slots 21 in the spring housing 8. After a specific swinging movement of the spring housing 8, the sole holder 7 can swing, assisted by the force of the opening spring 22 which biases it, past the slide member 11 and into its open position. After letting go of the spring housing 8, the open position which is illustrated in FIG. 3 is again reached, in which the heel holder 1 is in its position ready for a stepping in.

The inclination of the control path 20 of the recess 18 in the slide member 11 relative to the central longitudinal axis of the spring housing 8 is adjusted to the movement of slide member 11 in the longitudinal direction of the spring housing 8 so as to provide the movement of the slide member needed for a release in response to a pregiven angle of pivoting of the spring housing 8, and also depends on the position of the half bolts 9 relative to the location at which the control cam 17 engages the surface section **16*a* of the control surface 16 on the slide member 11**.

It is also possible to close the sole holder 7 with a lesser force than it is necessary during a normal swinging down of the sole holder 7 as a ski shoe steps in. For this purpose, starting out from the position illustrated in FIG. 3, the spring housing 8 is manually swung downwardly until the sole holder 7 can be easily swung past the slide member 11 and into its closed position. In this case, the long lever arm of the spring housing 8 becomes active.

To cover the bearing block 5 in directions toward the end of the ski, a cover part **5*a*** is provided which is resilient.

The invention is not limited to the illustrated exemplary embodiment. Further variations and modifications, including the rearrangement of parts, are possible without leaving the scope of protection. Thus, it is possible to place the portion of the surface on the slide member which engages the control cam of the sole holder in the downhill skiing position above a straight line which connects the swivel axle of the sole holder and the half bolts, whereby in this case during a release a greater swinging movement of the spring housing occurs. Also, the control path provided on the slide member for a voluntary opening can be curved. Thus, it is in particular conceivable to place the centerpoint of this curvature on a straight line which extends normal to the connecting line of the two possible end positions of the swivel axle of the sole holder along the control path. It is furthermore possible to arrange the point which determines the curvature of the curved surface section of the control surface on the slide member above the swivel axle of the sole holder. Also, the upper end of this surface section can be curved in a direction toward the sole holder, so that through this a stop to limit the upward swinging movement of the sole holder is created. In the illustrated exemplary embodiment, the swivel axle of the sole holder is below the central longitudinal axis of the spring housing. Said axle could, however, also be provided on such central longitudinal axis or above it.

Furthermore, it is possible to support the bearing block for pivotal movement about a vertical axis relative to the guide plate, and to provide at the same time a cam on the front end area of the guide plate which cooperates with a notch arranged on the sole holder, so that a so-called diagonal release or rather diagonal control exists. Since the measures which are needed for this are already known, no detailed disclosure thereof is necessary herein.

The embodiments of the invention in which an exclusive property or privilege is claimed are defined as follows:

1. A safety ski binding, in particular a heel holder, comprising a sole holder which is supported on a bearing block for pivotal movement about a swivel axle which extends transversely of the ski and parallel to the upper side of the ski, the sole holder being held in a downhill skiing position by a slide member which cooperates with a control surface on the sole holder and which is guided for movement against the force of a release spring in a spring housing which is supported on the bearing block for pivotal movement about an axis which extends parallel to the axle, the spring housing serving simultaneously as a spring housing and as a release member for effecting a voluntary opening of the sole holder, including a control surface on the slide member, wherein the control surface on the sole holder is a control cam, wherein the swivel axle of the sole holder is offset toward an end of the ski relative to the axis of the spring housing, wherein the slide member in the downhill skiing position engages the control cam of the sole holder in the region between the two axes, and wherein a control recess is provided in the slide member for the swivel axle of the sole holder.

2. The safety ski binding according to claim 1, wherein the control surface on the slide member includes two surface sections, of which the lower section, in the downhill skiing position of the binding, biases the control cam on the sole holder and in this position lies below a plane which intersects the pivot axis of and is parallel to the central longitudinal axis of the spring housing.

3. The safety ski binding according to claim 2, wherein the upper surface section of the control surface on the slide member is arcuate, the centerpoint of its curvature, in relationship to the central longitudinal axis of the spring housing, being offset with respect to the swivel axle of the sole holder in a direction toward the upper side of the ski and also in a direction toward the end of the ski.

4. The safety ski binding according to claim 2, wherein the lower surface section of the control surface on the slide member, which surface section engages the control cam on the sole holder in the downhill skiing position, is a flat surface which extends at an acute angle of about 30° with respect to the central longitudinal axis of the spring housing.

5. The safety ski binding according to claim 1, wherein the control recess of the slide member, through which the swivel axle of the sole holder extends, is approximately triangular when viewed in a side view and defines two axle control surfaces for the swivel axle of the sole holder, wherein one said axle control surface extends parallel to the central longitudinal axis of the spring housing and the other said axle control surface defines the end of the recess which is remote from the sole holder and is inclined in a direction toward the sole holder.

6. The safety ski binding according to claim 1, wherein the swivel axle of the sole holder extends through two slots which are provided in the sidewalls of the spring housing and are concentric with respect to the pivot axis of the spring housing.

7. The safety ski binding according to claim 1, wherein the pivot axis of the spring housing is formed by two half bolts which are each provided on a respective sidewall of the bearing block and pivotally support a respective sidewall of the spring housing.

* * * * *